US011959655B2

(12) United States Patent
Wei et al.

(10) Patent No.: US 11,959,655 B2
(45) Date of Patent: Apr. 16, 2024

(54) AIR-CONDITIONING SYSTEM, DATA TRANSMISSION METHOD AND APPARATUS, AND COMPUTER STORAGE MEDIUM

(71) Applicants: QINGDAO HAIER AIR-CONDITIONING ELECTRONIC CO., LTD., Qingdao (CN); QINGDAO HAIER SMART TECHNOLOGY R&D CO., LTD., Qingdao (CN); HAIER SMART HOME CO., LTD., Qingdao (CN)

(72) Inventors: Wei Wei, Qiangdao (CN); Yongjun Zhao, Qiangdao (CN); Li Chen Zhang, Qiangdao (CN)

(73) Assignees: QINGDAO HAIER AIR-CONDITIONING ELECTRONIC CO., LTD., Qingdao (CN); QINGDAO HAIER SMART TECHNOLOGY R&D CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 257 days.

(21) Appl. No.: 17/612,923

(22) PCT Filed: Jul. 11, 2019

(86) PCT No.: PCT/CN2019/095541

§ 371 (c)(1),
(2) Date: Nov. 19, 2021

(87) PCT Pub. No.: WO2020/186661

PCT Pub. Date: Sep. 24, 2020

(65) Prior Publication Data

US 2022/0221182 A1 Jul. 14, 2022

(30) Foreign Application Priority Data

Mar. 19, 2019 (CN) ..... 201910206061.6

(51) Int. Cl.
*F24F 11/58* (2018.01)
*F24F 11/30* (2018.01)
(Continued)

(52) U.S. Cl.
CPC ..... *F24F 11/58* (2018.01); *F24F 11/30* (2018.01); *F24F 11/63* (2018.01); *F24F 2110/10* (2018.01)

(58) Field of Classification Search
CPC .. F24F 11/30; F24F 11/89; F24F 11/46; F24F 11/58; F24F 11/63; F24F 2110/10; F24F 11/64; F24F 11/79
See application file for complete search history.

(56) References Cited

U.S. PATENT DOCUMENTS

2003/0070440 A1* 4/2003 Seong ..... F24F 11/30 236/51
2009/0281667 A1* 11/2009 Masui ..... F24F 11/74 700/276
(Continued)

FOREIGN PATENT DOCUMENTS

CN 102679515 A 9/2012
CN 203719041 U 7/2014
(Continued)

OTHER PUBLICATIONS

First Office Action for Chinese Patent Application No. 201910206061.6, dated Feb. 2, 2021, 18 pages (9 pages of Official copy and 9 pages of English translation).
(Continued)

*Primary Examiner* — Alicia M. Choi
(74) *Attorney, Agent, or Firm* — Nitin Kaushik

(57) ABSTRACT

Provided are an air-conditioning system, a data transmission method and apparatus, and a non-transitory computer storage medium. A centralized air-conditioning controller, at
(Continued)

least one air conditioner, and at least one environmental information collection module are provided. The environmental information collection module detects current environmental data information of an area where the air conditioner that has been matched through networking is located, sends the current environmental data information to the air conditioner that has been matched through networking for the air conditioner controlling the operation of at least one device of the air conditioner according to the received information, and sends the current environmental data information and saved identity identification information of the air conditioner that has been matched through networking to the centralized air-conditioning controller for the centralized air-conditioning controller monitoring and controlling the operation of the air conditioner according to the received information.

7 Claims, 14 Drawing Sheets

(51) Int. Cl.
*F24F 11/63* (2018.01)
*F24F 110/10* (2018.01)

(56) References Cited

U.S. PATENT DOCUMENTS

2014/0312130 A1* 10/2014 Kawai ..... F24F 11/30 236/51
2015/0204561 A1* 7/2015 Sadwick ..... F24F 11/33 236/1 C
2015/0338116 A1* 11/2015 Furuta ..... F24F 11/30 700/276
2016/0178225 A1* 6/2016 Vallikannu ..... F24F 11/30 700/275
2017/0138626 A1 5/2017 Lu et al.
2018/0172289 A1* 6/2018 Hur ..... F24F 3/065
2019/0093915 A1* 3/2019 Lee ..... F24F 1/0003
2020/0217536 A1* 7/2020 Guan ..... F24F 11/58
2021/0320898 A1* 10/2021 Doumae ..... H04L 12/46
2021/0404684 A1* 12/2021 Sugiyama ..... G05B 19/042

FOREIGN PATENT DOCUMENTS

CN 104748315 A 7/2015
CN 105020867 A 11/2015
CN 105387563 A 3/2016
CN 105972757 A 9/2016
CN 106288221 A 1/2017
CN 206234965 U 6/2017
CN 206648248 U 11/2017
CN 107504642 A 12/2017
CN 207350711 U 5/2018
CN 208205335 U 12/2018

OTHER PUBLICATIONS

PCT International Search Report and Written Opinion; International Patent Application No. PCT/CN2019/095541; dated Sep. 26, 2019, 11 pages (5 pages of Official copy and 6 pages of English translation).

* cited by examiner

AIR-CONDITIONING SYSTEM, DATA TRANSMISSION METHOD AND APPARATUS, AND COMPUTER STORAGE MEDIUM

CROSS-REFERENCE TO RELATED APPLICATIONS

This application is a U.S. national phase entry of, and claims priority to, PCT International Phase Application No. PCT/CN2019/095541, filed Jul. 11, 2019, which claims priority to Chinese patent application No. CN 201910206061.6, filed Mar. 19, 2019. The entire contents of the above-referenced applications and of all priority documents referenced in the Application Data Sheet filed herewith are hereby incorporated by reference for all purposes.

TECHNICAL FIELD

The present application relates to the technical field of air conditioners, and in particular to an air-conditioning system, a data transmission method and apparatus, and a computer storage medium.

BACKGROUND

With the improvement of living standards, air conditioners have become more and more commonly used and can be divided into vertical air conditioners, hanging air conditioners and embedded air conditioners according to the installation mode.

Currently, a domestic central air conditioner can acquire temperature information via a temperature sensor installed at an air outlet of the air conditioner in each room, and adjust the operation of the air conditioner (for example the mode of operation, and the corresponding refrigerating capacity, air volume, etc.) according to the acquired temperature information and preset temperature information, so as to achieve the effect of adjusting the temperature of a working area.

In implementing the embodiments of the present disclosure, it has been found that the related art has at least the following problems that:

due to the large difference in installation mode, spatial position, etc. of an air conditioner, it is difficult to fully and accurately reflect the environmental information of the working area only through the temperature information collected by the temperature sensor on the air conditioner, so that the environmental parameters of the working area under the air conditioner adjustment are not very accurate, which will affect the comfort and experience of users.

SUMMARY

In order to provide a basic understanding of some aspects of the disclosed embodiments, a brief summary is given below. This summary is not a general comment, nor is it intended to determine key/important constituting elements or describe the right protection scope of these embodiments. It serves as a preface to the detailed description that follows.

An embodiment of the present disclosure provides an air conditioning system.

In some embodiments, the air conditioning system includes: a centralized air-conditioning controller, at least one air conditioner, and at least one environmental information collection module located in a working area of each air conditioner.

The environmental information collection module is used for detecting, when a preset detection time is reached, current environmental data information of an area where the air conditioner that has been matched through networking is located, and sending, by means of wireless short-range communication, the current environmental data information to the air conditioner that has been matched through networking, and sending, when reception acknowledgment information returned by the air conditioner that has been matched through networking is received and by means of radio frequency communication, the current environmental data information and saved identity identification information of the air conditioner that has been matched through networking to the centralized air-conditioning controller;

the air conditioner is used for controlling an operation of at least one device of the air conditioner according to the received current environmental data information;

The centralized air-conditioning controller is used for monitoring and controlling the operation of the air conditioner according to the received current environmental data information and the identity identification information.

An embodiment of the present disclosure provides a data transmission method in an air conditioning system.

In some embodiments, the air conditioning system includes: a centralized air-conditioning controller, at least one air conditioner, and at least one environmental information collection module located in a working area of each air conditioner, wherein the environmental information collection module uses wireless short-range communication with the corresponding air conditioner, and uses radio frequency communication with the centralized air-conditioning controller. The method includes:

when a preset detection time is reached, detecting current environmental data information about an area where the air conditioner that has been matched through networking is located, and by means of wireless short-range communication, sending the current environmental data information to the air conditioner that has been matched through networking;

and when receiving reception acknowledgment information returned by the air conditioner that has been matched through networking, by means of radio frequency communication, sending the current environmental data information and identity identification information about the air conditioner that has been matched through networking to the centralized air-conditioning controller.

An Embodiment of the present disclosure provides a data transmission apparatus in an air conditioning system.

In some embodiments, the air conditioning system includes: a centralized air-conditioning controller, at least one air conditioner, and at least one environmental information collection module located in a working area of each air conditioner, wherein the environmental information collection module uses wireless short-range communication with the corresponding air conditioner, and uses radio frequency communication with the centralized air-conditioning controller. The apparatus includes:

a first communication unit configured to, when a preset detection time is reached, detect current environmental data information about an area where the air conditioner that has been matched through networking is located, and by means of wireless short-range communication, send the current environmental data information to the air conditioner that has been matched through networking;

and a second communication unit configured to, when receiving reception acknowledgment information returned by the air conditioner that has been matched through networking, by means of radio frequency communication, send the current environmental data information and identity identification information about the air conditioner that has been matched through networking to the centralized air-conditioning controller.

An embodiment of the present disclosure provides a data transmission apparatus in an air conditioning system for use in an environmental information collection module.

In some embodiments, the air conditioning system includes: a centralized air-conditioning controller, at least one air conditioner, and at least one environmental information collection module located in a working area of each air conditioner, wherein the environmental information collection module uses wireless short-range communication with the corresponding air conditioner, and uses radio frequency communication with the centralized air-conditioning controller. The apparatus includes:

a processor;

and a memory for storing a processor-executable instruction;

wherein the processor is configured to:

when a preset detection time is reached, detect current environmental data information about an area where the air conditioner that has been matched through networking is located, and by means of wireless short-range communication, send the current environmental data information to the air conditioner that has been matched through networking;

and when receiving reception acknowledgment information returned by the air conditioner that has been matched through networking, by means of radio frequency communication, send the current environmental data information and identity identification information about the air conditioner that has been matched through networking to the centralized air-conditioning controller.

An embodiment of the present disclosure provides a computer-readable storage medium.

In some embodiments, the computer-readable storage medium stores a computer-executable instruction configured to execute the above-mentioned data transmission method in an air conditioning system.

An embodiment of the present disclosure provides a computer program product.

In some embodiments, the computer program product includes a computer program stored on a computer-readable storage medium. The computer program includes program instructions that, when executed by a computer, cause the computer to execute the above-mentioned data transmission method in an air conditioning system.

Some technical solutions provided by the embodiments of the present disclosure can achieve the following technical effects.

In the embodiments of the present disclosure, the air conditioner is matched with one, two, or more environmental information collection modules through networking so that the current operation mode of at least one device in the air conditioner can be adjusted according to the environmental information collected by any one of the environmental information collection modules. Therefore, the control quality in the working area can be detected relatively comprehensively by at least one environmental information collection module, and corresponding air conditioner control can be performed, thereby achieving the control optimization of the air conditioner. In addition, the environmental information collection module can adopt a dual-mode communication mode to realize the communication of environmental data among the environmental information collection module, the air conditioner, and the centralized air-conditioning controller. In this way, power consumption is reduced, frequent changes in communication protocols are avoided, and communication reliability is improved.

The foregoing general description and the following description are exemplary and explanatory only and are not restrictive of the application.

BRIEF DESCRIPTION OF DRAWINGS

One or more embodiments are exemplified by the accompanying drawings corresponding thereto. These exemplified descriptions and drawings do not constitute a limitation of the embodiments. Elements in the drawings having the same reference number designation are illustrated as similar elements and the drawings do not constitute a proportional limitation and wherein.

DETAILED DESCRIPTION OF THE EMBODIMENTS

Figure 1:
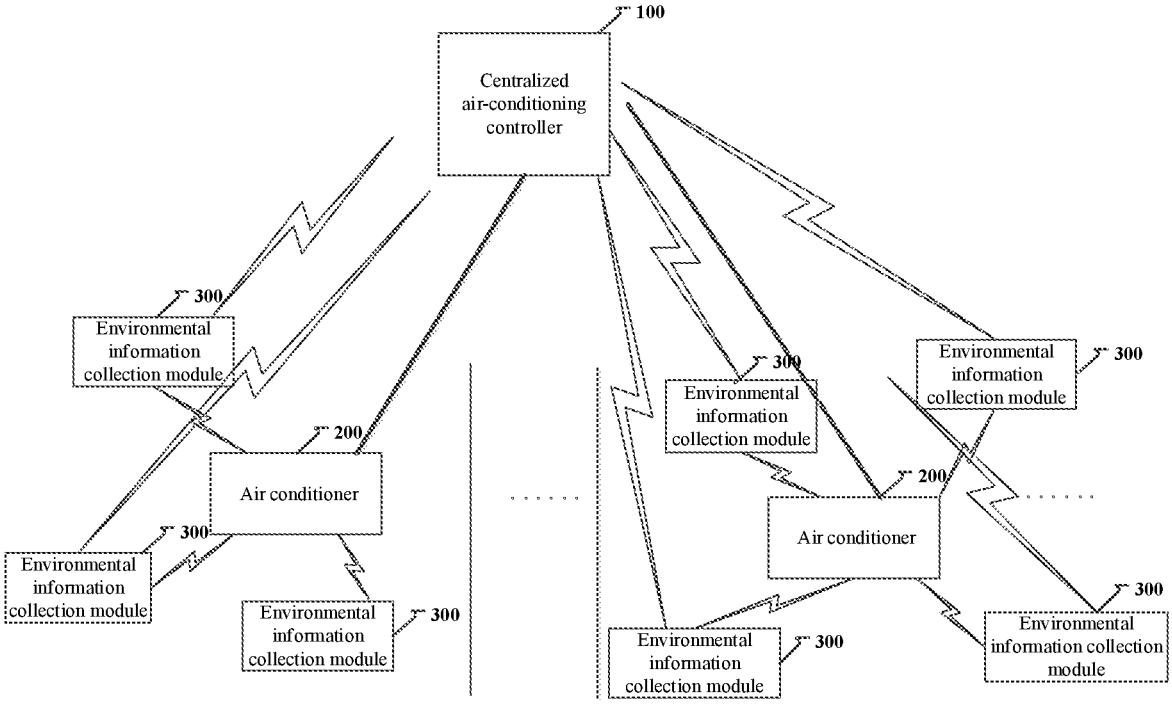
FIG. 1 is an architecture diagram of an air conditioning system provided by an embodiment of the present disclosure.

In order to provide a more detailed understanding of the features and technical content of the embodiments of the present disclosure, the implementation of the embodiments of the present disclosure will be described in detail below with reference to the accompanying drawings. The attached drawings are for reference only and are not used to limit the embodiments of the present disclosure. In the following technical description, for the convenience of explanation, a number of details are used to provide a sufficient understanding of the disclosed embodiments. However, one or more embodiments may still be implemented without these details. In other instances, well-known structures and apparatuses may be shown in simplified form in order to simplify the drawing.

Household central air conditioners have been commonly used. The air conditioners in each room can be individually controlled, while the centralized air-conditioning controller can perform data monitoring, statistics, and control on the air conditioners in each room. In the embodiments of the present disclosure, the air-conditioning system not only comprises a centralized air-conditioning controller and at least one air conditioner, but also comprises one, two, or more environmental information collection modules located in the working area of each air conditioner, so that the current operation mode of at least one device in the air conditioner can be adjusted according to the environmental information collected by the environmental information collection module. Therefore, the control quality in the working area can be detected relatively comprehensively by the environmental information collection module, and corresponding air-conditioning control can be performed, so that the control optimization and energy-saving of the air conditioner are realized, and the comfort and experience of the user can also be further improved.

In the embodiment, the air conditioning system includes: a centralized air-conditioning controller, at least one air conditioner, and at least one environmental information collection module located in a working area of each air conditioner. The air conditioner may be a vertical air conditioner, a hanging air conditioner, or an embedded air conditioner, and the like. The environmental information collection module may be one, two, or more of a temperature sensor, a humidity sensor, a fine particle detection apparatus, a formaldehyde detection apparatus, a human body detection sensor, and a carbon monoxide detection sensor, and the like.

FIG. 1 is an architecture diagram of an air conditioning system according to one exemplary embodiment. As shown in FIG. 1, a centralized air-conditioning controller 100, at least one air conditioner 200, and at least one environmental information collection module 300 located in a working area of each air conditioner.

The environmental information collection module 300 is used for detecting the current environmental data information about the area where the air conditioner having been matched through networking is located, and sending, respectively by means of wireless short-range communication, the current environmental data information to the air conditioner 200 having been matched through networking, and sending, by means of radio frequency communication, the current environmental data information to the centralized air-conditioning controller 100.

The air conditioner 200 is used for controlling the operation of at least one device of the air conditioner according to the received current environmental data information.

The centralized air-conditioning controller 100 is used for monitoring and controlling the operation of the air conditioner 200 according to the received current environmental data information.

It can be seen that the environmental information collection module can adopt a dual-mode communication mode so that the environmental data can be communicated among the environmental information collection module, the air conditioner, and the centralized air-conditioning controller. Among them, in the embodiments of the present disclosure, the wireless short-range communication may include: Wi-Fi communication, Bluetooth communication, ZigBee communication, or infrared communication technology, and so on. Preferably, the wireless short-range communication may be Bluetooth communication. Since Bluetooth communication has the characteristics of weak through-wall capability, low power consumption, etc., it is suitable for short-range frequent data transmission. Therefore, in this embodiment, the environmental information collection module can use Bluetooth communication with the air conditioner. The radio frequency communication, having the strong through-wall capability, is suitable for the transmission between different rooms. So the radio frequency communication can be used between the environmental information collection module and the centralized air-conditioning controller. For example, 2.4 GHz radio frequency communication can be used between the environmental information collection module and the centralized air-conditioning controller. It is possible that through wireless routing equipment, 2.4 GHz radio frequency communication can be used between the environmental information collection module and the centralized air-conditioning controller. Alternatively, the centralized air-conditioning controller includes a wireless routing function.

Each environmental information collection module can periodically monitor the uploaded data according to the capability of dual-mode communication. Preferably, the environmental information collection module 300 is used for detecting, when a preset detection time is reached, current environmental data information of an area where the air conditioner 200 that has been matched through networking is located, and sending, by means of wireless short-range communication, the current environmental data information to the air conditioner 200 that has been matched through networking, and sending, when reception acknowledgment information returned by the air conditioner 200 that has been matched through networking is received and by means of radio frequency communication, the current environmental data information and saved identity identification information of the air conditioner that has been matched through networking to the centralized air-conditioning controller 100.

The air conditioner 200 is used for controlling the operation of at least one device of the air conditioner according to the received current environmental data information;

The centralized air-conditioning controller 100 is used for monitoring and controlling the operation of the air conditioner 200 according to the received current environmental data information and the identity identification information.

The environmental information collection module adopts the strategy of periodically monitoring and reporting data, which can reduce the pressure of system operation and reduce the occupation of network resources.

The air conditioning system includes one, two, or more air conditioners, and further includes one, two, or more environmental information collection modules. However, not every air conditioner can perform wireless short-range communication with every environmental information collection module, and the air conditioner needs to perform matching through networking with a corresponding environmental information collection module.

The air conditioner 200 is also used for sending identity identification information to the current environmental information collection module 300 when it is determined that the signal strength of the wireless short-range communication signal of the current environmental information collection module 300 satisfies a set condition; receiving binding feedback information sent by the current environmental information collection module 300 after the current environmental information collection module 300 stores identity identification information and performing matching through networking with the current environmental information collection module 300.

Preferably, the air conditioner 200 is used for monitoring the wireless short-range communication signal of the current environmental information collection module; when the signal strength of the wireless short-range communication signal is greater than the set strength value for longer than the set time, it is determined that the signal strength of the wireless short-range communication signal satisfies the set condition. The air conditioner 200 then sends the identity identification information to the current environmental information collection module, so that the current environmental information collection module 300 receives and saves the identity identification information, and sends binding feedback information to the air conditioner 200. So the air conditioner and the current environmental information collection module 300 are matched through networking.

Alternatively, the environmental information collection module 300 is used for sending a binding request signal to the air conditioner through wireless short-range communication. The air conditioner 200 is used for receiving the binding request signal and determining, when the signal strength of the binding request signal is greater than the set strength value, that the signal strength of the wireless short-range communication signal satisfies the set condition. The air conditioner 200 then sends the identity identification information to the current environmental information collection module, so that the current environmental information collection module 300 receives and saves the identity identification information, and sends binding feedback information to the air conditioner 200. So the air conditioner and the current environmental information collection module 300 are matched through networking.

Of course, in the embodiments of the present disclosure, the air conditioner is also used for performing matching through networking with the centralized air-conditioning controller by means of a communication bus. That is, the communication mode between the air conditioner and the centralized air-conditioning controller is unchanged so that data between the air conditioner and the centralized air-conditioning controller can be saved synchronously, and the centralized air-conditioning controller can continue to monitor and control the corresponding air conditioner.

After setting up the air conditioning system, the air conditioner can control the operation of at least one device of the air conditioner according to the acquired current environmental data information.

In an embodiment of the present disclosure, an air conditioner 200 is used for acquiring current environmental data information detected by an environmental information collection module that has been matched through networking; determining a current control mode matching the current environmental data information; and, according to the current control mode, controlling the operation of the air conditioner in the operating state.

Preferably, the air conditioner 200 is used for determining the heating mode as the current control mode when the acquired current environmental temperature detected by at least one second environmental information collection module is less than the lower limit value of the set temperature range; determining the cooling mode as the current control mode when the acquired current environmental temperature detected by at least one second environmental information collection module is greater than the upper limit value of the set temperature range; and determining the dehumidification mode as the current control mode when the acquired current environmental temperature detected by each second environmental information collection module is within the set temperature range, and the current environment humidity detected by at least one third environmental information collection module is greater than the set humidity.

In another embodiment of the present disclosure, an air conditioner 200 is used for acquiring current environmental data information detected by an environmental information collection module that has been matched through networking; when the acquired current environment temperature detected by a second environmental information collection module is greater than a set temperature, determining the second environmental information collection module to be an environmental information collection module to be supplied with air; determining a relative position with the environmental information collection module to be supplied with air; and adjusting an air deflector of an air conditioner in an operating state to supply air directionally to an area matching the relative position.

Preferably, the air conditioner 200 is used for determining the arrival direction information of the wireless short-range communication signal carrying the current environment temperature; and, according to the arrival direction information, determining the relative position with the environmental information collection module to be supplied with air through the angle-of-arrival AOV location algorithm.

It can be seen therefrom that the air conditioner in the operating state can control the operation of at least one device of the air conditioner according to the acquired current environmental data information. The embodiments of the present disclosure are not limited to this, and the start operation of the air conditioner can also be controlled according to the environmental data information. Namely, the air conditioner 200 is used for starting the air conditioner to be in an operating state when the acquired number of human bodies detected by the first environmental information collection module is greater than a set value and the acquired environment temperature detected by at least one second environmental information collection module is not within a set temperature range.

It can be seen that in the air-conditioning system, the air conditioner can adjust the current operation mode of at least one device in the air conditioner according to the environmental information collected by the environmental information collection module, so that the control quality in the working area can be detected relatively comprehensively by the environmental information collection module, and the corresponding air conditioner control can be performed. Therefore, the control optimization and energy-saving of the air conditioner are realized, and the comfort and experience of the user can also be further improved.

In the air conditioning system, each element in the air conditioning system needs to be matched through networking.

Figure 2:
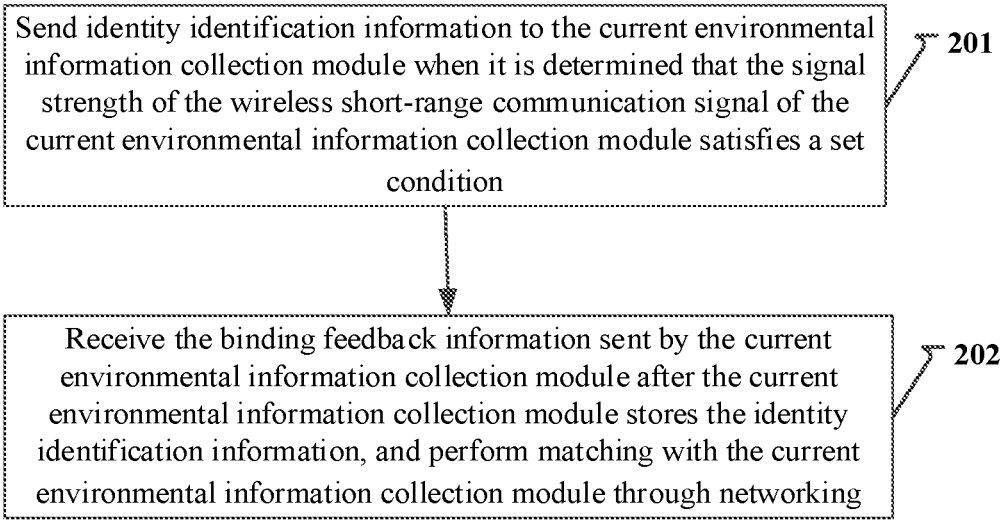
FIG. 2 is a flowchart of a method for an element to be matched through networking in an air conditioning system provided by an embodiment of the present disclosure.

FIG. 2 is a flowchart of a method for matching elements through networking in an air conditioning system according to one exemplary embodiment. The air conditioning system may be as described above, therefore, the elements in the air conditioning system include: a centralized air-conditioning controller, an air conditioner, and an environmental information collection module. Preferably, the air conditioning system includes: a centralized air-conditioning controller, at least one air conditioner, and at least one environmental information collection module located in a working area of each air conditioner, wherein the environmental information collection module uses wireless short-range communication with the corresponding air conditioner, and uses radio frequency communication with the centralized air-conditioning controller. As shown in FIG. 2, the procedure of matching elements through networking in an air-conditioning system includes:

step 201: sending identity identification information to the current environmental information collection module when it is determined that the signal strength of the wireless short-range communication signal of the current environmental information collection module satisfies a set condition.

In the embodiments of the present disclosure, wireless short-range communication is adopted between the air conditioner and the environmental information collection module. Wireless short-range communication is featured with poor through-wall property, long distance, and low power consumption. Therefore, the air conditioner is generally matched with the environmental information collection module in the same room through networking. And the distance between the two cannot be too far, for example no more than two meters.

In the embodiments of the present disclosure, the environmental information collection module can be fixedly installed at a certain position or can be moved. Of course, the environmental information collection module may be: a temperature sensor, a humidity sensor, a fine particle detection apparatus, a formaldehyde detection apparatus, a human body detection sensor, and a carbon monoxide detection sensor, and the like.

One environmental information collection module is added to the system, and needs to be matched with a corresponding air conditioner through networking. Alternatively, when the system is constructed, the air conditioner also needs to be matched with the environmental information collection module through networking. The air conditioner can actively perform matching with the environmental information collection module through networking, and the environmental information collection module can also actively perform matching through networking. Preferably, step 201 may include: monitoring the wireless short-range communication signal of the current environmental information collection module; and when the time when the signal strength of the wireless short-range communication signal is greater than the set strength value is greater than a set time, determining that the signal strength of the wireless short-range communication signal satisfies the set condition.

For example: when a moving current environmental information collection module approaches a certain air conditioner, and generally after being within 2 meters, the air conditioner can monitor a Bluetooth signal of the current environmental information collection module; and when a monitored Received Signal Strength Indication of the Bluetooth signal is greater than −20 dbm and the duration exceeds 5 s, it can be confirmed that the signal strength of the Bluetooth signal satisfies the set condition, and therefore, the air conditioner can send identity identification information, such as an ID, to the current environmental information collection module.

Or determining that the signal strength of the wireless short-range communication signal of the current environmental information collection module satisfies a set condition may include: receiving a binding request signal sent by the current environmental information collection module via wireless short-range communication; and when the signal strength of the binding request signal is greater than the set strength value, determining that the signal strength of the wireless short-range communication signal satisfies the set condition.

For example: when a moving current environmental information collection module approaches a certain air conditioner, and generally after being within 2 meters, a user can trigger the current environmental information collection module so that the current environmental information collection module sends the binding request signal via Bluetooth communication; in this way, only if the signal strength of the binding request signal is greater than −20 dbm, it can be confirmed that the signal strength of the Bluetooth signal satisfies the set condition, and therefore, the air conditioner can send identity identification information, such as an ID, to the current environmental information collection module.

Step 202: receiving the binding feedback information sent by the current environmental information collection module after the current environmental information collection module stores the identity identification information, and performing matching with the current environmental information collection module through networking.

After receiving the identity identification information, the current environmental information collection module stores the identity identification information, and then sends the binding feedback information to the air conditioner, namely, the air conditioner and the current environmental information collection module are matched through networking.

In this way, after collecting the environmental data information, the current environmental information collection module will send the environmental data information to the corresponding air conditioner according to the stored identity identification information.

Of course, the matching through networking method between the air conditioner and the centralized air-conditioning controller in the air conditioning system is unchanged, namely, the air conditioner uses a communication bus manner to perform matching with the centralized air-conditioning controller through networking.

It can be seen that in the present embodiment, the air conditioner can perform matching with the corresponding environmental information collection module through networking according to the signal strength of the wireless short-range communication signal, and in this way, the matching through networking manner is simple and easy to operate, and the constructing efficiency of the air conditioning system architecture is improved.

The air conditioner is matched with the environmental information collection module and the centralized air-conditioning controller through networking, and after the air conditioning system is constructed, the air conditioner can be specifically controlled according to the data transmitted between the environmental information collection module, the air conditioner, and the centralized air-conditioning controller.

Figure 3:
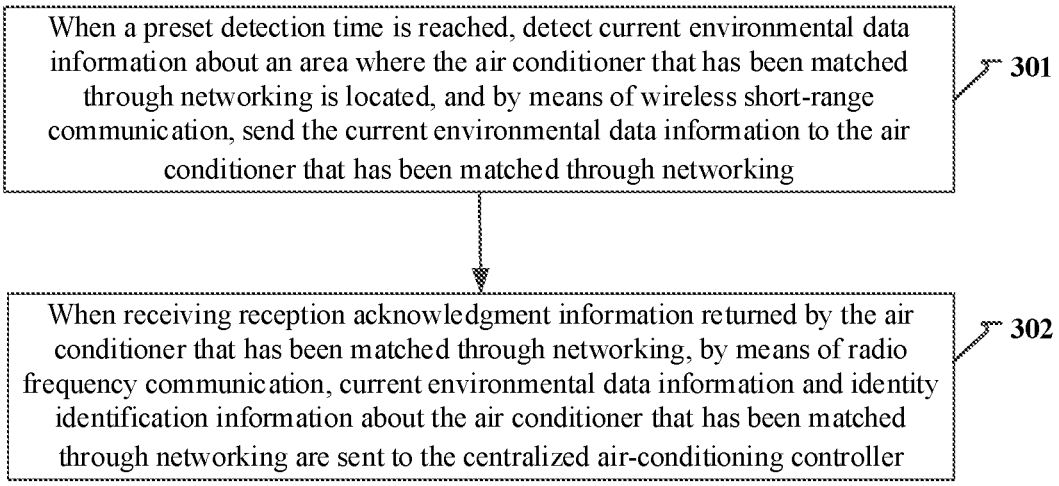
FIG. 3 is a flowchart of a data transmission method in an air conditioning system provided by an embodiment of the present disclosure.

FIG. 3 is a flowchart of a data transmission method in an air conditioning system according to an exemplary embodiment. The air conditioning system may be as described above, that is, the air conditioning system includes: a centralized air-conditioning controller, at least one air conditioner, and at least one environmental information collection module located in a working area of each air conditioner, wherein the environmental information collection module uses wireless short-range communication with the corresponding air conditioner, and uses radio frequency communication with the centralized air-conditioning controller. As shown in FIG. 3, the procedure of data transmission in an air conditioning system includes:

step 301: when a preset detection time is reached, detecting current environmental data information about an area where the air conditioner that has been matched through networking is located, and by means of wireless short-range communication, sending the current environmental data information to the air conditioner that has been matched through networking.

The detection time can be preset, for example 3 min, 5 min, 6 min, 8 min, 10 min, etc. and the environmental information collection module is matched with the air conditioner through networking, namely, the identity identification information about the air conditioner matched through networking is stored. In this way, at every preset detection time, the environmental information collection module can detect the current environmental data information, and send the current environmental data information to the corresponding air conditioner by means of wireless short-range communication according to the stored air conditioner identity identification information.

Step 302: when receiving reception acknowledgment information returned by the air conditioner that has been matched through networking, by means of radio frequency communication, sending current environmental data information and identity identification information about the air conditioner that has been matched through networking to the centralized air-conditioning controller.

After sending the information to the air conditioner is successful, 2.4 GHz radio frequency communication can be used to send the current environmental data information and identity identification information about the air conditioner that has been matched through networking to the centralized air-conditioning controller. In this way, the centralized air-conditioning controller can synchronize the data information received by the corresponding air conditioner, thereby further enhancing the monitoring of the air conditioner.

It can be seen that in the present embodiment, the environmental information collection module can adopt a dual-mode communication mode so that environmental data can be communicated among the environmental information collection module, the air conditioner, and the centralized air-conditioning controller. In this way, power consumption is reduced, frequent changes in communication protocols are avoided, and communication reliability is improved.

Of course, in the data transmission process, the environmental information collection module and the air conditioner need to match through networking, and the data transmission process in the matching through networking may include: receiving identity identification information sent by the air conditioner, wherein the identity identification information is sent to the current environmental information collection module when the air conditioner determines that the signal strength of the wireless short-range communication signal of the current environmental information collection module satisfies a set condition; after the identity identification information is stored, the binding feedback information is sent to the air conditioner.

Preferably, when the wireless short-range communication signal is a binding request signal, it is also necessary to send the binding request signal to the air conditioner through wireless short-range communication. As such, the air conditioner sends the identity identification information when determining that the signal strength of the binding request signal is greater than a set strength value.

In the air conditioning system, after the environmental data information collected by the environmental information collection module is transmitted among the environmental information collection module, the air conditioner, and the centralized air-conditioning controller, the operation of at least one device of the air conditioner can be controlled according to the environmental data information.

Figure 4:
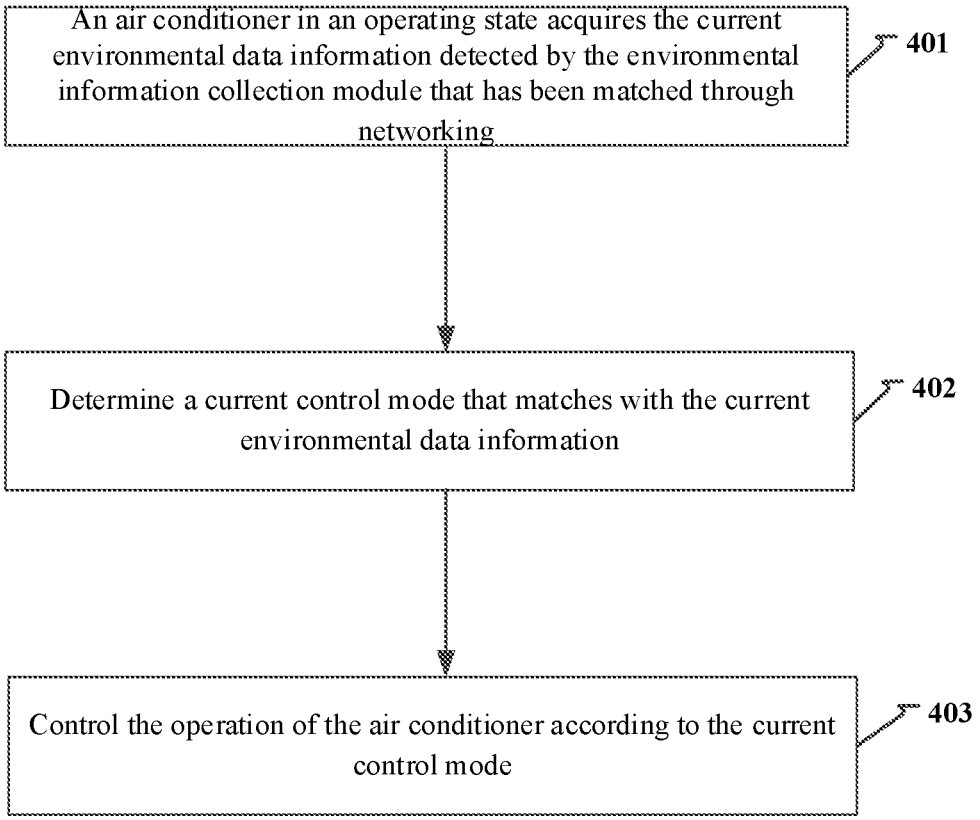
FIG. 4 is a flowchart of an air conditioner control method in an air conditioning system provided by an embodiment of the present disclosure.

FIG. 4 is a flowchart of an air conditioner control method in an air conditioning system according to an exemplary embodiment. The air conditioning system may be as described above, that is, the air conditioning system includes: a centralized air-conditioning controller, at least one air conditioner, and at least one environmental information collection module located in a working area of each air conditioner, wherein the environmental information collection module uses wireless short-range communication with the corresponding air conditioner, and uses radio frequency communication with the centralized air-conditioning controller. As shown in FIG. 4, the process of air conditioner control in the air conditioning system includes:

step 401: an air conditioner in an operating state acquiring current environmental data information detected by the environmental information collection module that has been matched through networking.

The air conditioner is in an operating state, i.e. the device of the air conditioner having the temperature adjusting function has already started to operate. For example: the compressor is operating. Of course, other devices, a solenoid valve, an air deflector, etc. may also be operating, i.e. at least one device associated with the temperature control function of the air conditioner is already operating.

The environmental information collection module can periodically detect environmental data information, and send, by means of wireless short-range communication, the detected current environmental data information to the air conditioner that has been matched through networking. The air conditioner can be matched with one, two, or more environmental information collection modules through networking so that one, two, or more current environmental data information can be acquired.

Step 402: determining the current control mode that matches the current environmental data information.

There is one, two, or more of the current environmental data information. For example: the current number of human bodies uploaded by one human body detection module, the current environment humidity uploaded by two humidity sensors, the current environment temperature uploaded by three temperature sensors, etc. Different current environmental data information can be pre-configured with different operating strategies. For example: when the PM2.5 value uploaded by at least one PM2.5 detection device is greater than a set concentration value, it is determined that the purification mode is the current control mode.

Preferably, in this embodiment, the first environmental information collection module may be a human body detection module, the second environmental information collection module may be a temperature sensor, and the third environmental information collection module may be a humidity sensor. In this way, determining the heating mode as the current control mode when the acquired current environmental temperature detected by at least one second environmental information collection module is less than the lower limit value of the set temperature range; determining the cooling mode as the current control mode when the acquired current environmental temperature detected by at least one second environmental information collection module is greater than the upper limit value of the set temperature range; and determining the dehumidification mode as the current control mode when the acquired current environmental temperature detected by each second environmental information collection module is within the set temperature range, and the current environment humidity detected by at least one third environmental information collection module is greater than the set humidity.

For example: one set temperature range, (18, 26), (15, 25) or (16, 27), etc. can be predetermined, so that when the set temperature range is (18, 26), if at least one current environment temperature is less than 18° C., the heating mode is determined to be the current control mode; it is determined that the cooling mode is the current control mode if at least one of the current environment temperatures is greater than 26° C.; if each current environment temperature is in (18, 26) and at least one current environment humidity is greater than 65%, the dehumidification mode may be determined to be the current control mode. Of course, if each current environment temperature is in (18, 26) and each current environment humidity is not greater than 65%, then the energy-saving mode may be determined to be the current control mode.

The pre-configured operating strategy is different for different current environmental data information, and therefore, the process of determining a current control mode matching with the current environmental data information is different, which is not exemplified one by one.

Step 403: controlling the operation of the air conditioner according to the current control mode.

Of course, the operating parameters of the functional devices of the air conditioner in the heating mode, the cooling mode, and the dehumidification mode are different, namely, according to the current control mode, the operation of at least one device in the air conditioner can be controlled.

It can be seen that in the present embodiment, the air conditioner can adjust the current operation mode of at least one device in the air conditioner according to the environmental information collected by the environmental information collection module, so that the control quality in the working area can be detected relatively comprehensively by the environmental information collection module, and the corresponding air conditioner control can be performed. Therefore, the control optimization and energy-saving of the air conditioner are realized, and the comfort and experience of the user can also be further improved.

In this embodiment, it is possible to control not only the air conditioner in the operating state but also the air conditioner not in operation, thereby further improving the intelligence of the air conditioner control and improving the user's experience. It may include: starting the air conditioner to be in an operating state when the acquired number of human bodies detected by the first environmental information collection module is greater than a set value and the acquired environment temperature detected by at least one second environmental information collection module is not within a set temperature range.

Likewise, the environmental information collection module can periodically detect environmental data information, and send, by means of wireless short-range communication, the detected environmental data information to the air conditioner that has been matched through networking. Therefore, if the information those the number of human bodies greater than the set value and there is an environment temperature that is not within the set temperature range are included in the monitored environmental data information of the air conditioner, the air conditioner can be started to be in the operating state.

For example: when the number of human bodies detected by the human body detection module is greater than 0, and the environment temperature detected by at least one temperature sensor is not in (18, 26), the air conditioner can be started to be in the operating state.

Of course, before controlling the air conditioner, the air conditioner needs to perform matching with the environmental information collection module through networking, and it may include: sending identity identification information to the current environmental information collection module when it is determined that the signal strength of the wireless short-range communication signal of the current environmental information collection module satisfies a set condition; and receiving binding feedback information sent by the current environmental information collection module after the current environmental information collection module stores identity identification information and performing matching with the current environmental information collection module through networking. Performing matching through networking via the signal strength, the operation process is simple and improves the efficiency of matching through networking.

In the air-conditioning system, not only the operating mode of the air conditioner can be controlled according to the environmental data information, but also the air supply direction of the air conditioner can be controlled according to the environmental data information.

Figure 5:
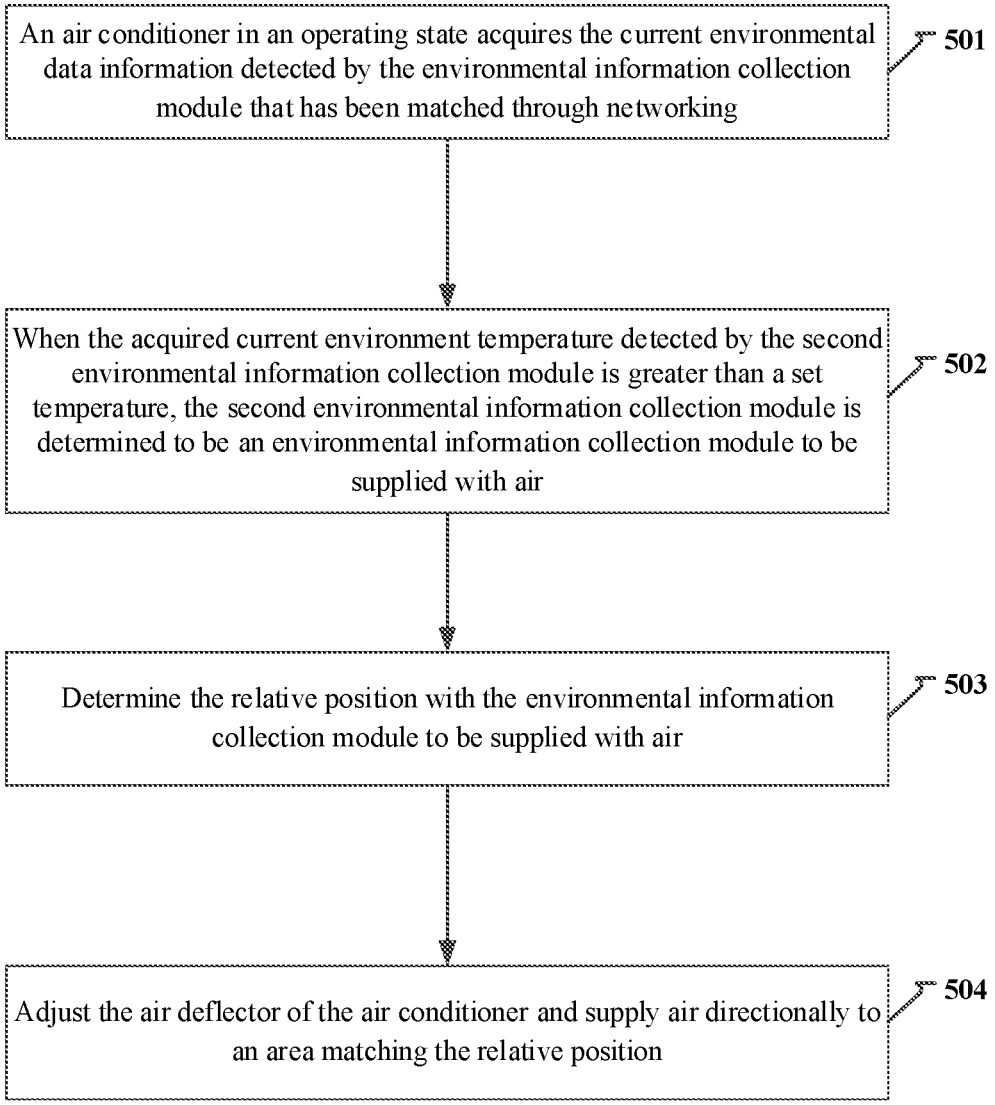
FIG. 5 is a flowchart of an air conditioner control method in an air conditioning system provided by an embodiment of the present disclosure.

FIG. 5 is a flowchart of an air conditioner control method in an air conditioning system according to an exemplary embodiment. The air conditioning system may be as described above, that is, the air conditioning system includes: a centralized air-conditioning controller, at least one air conditioner, and at least one environmental information collection module located in a working area of each air conditioner, wherein the environmental information collection module uses wireless short-range communication with the corresponding air conditioner, and uses radio frequency communication with the centralized air-conditioning controller. As shown in FIG. 5, the process of air conditioner control in the air conditioning system includes:

step 501: an air conditioner in an operating state acquiring current environmental data information detected by the environmental information collection module that has been matched through networking.

This step is identical to the process of step 401 and will not be repeated.

Step 502: when the acquired current environment temperature detected by the second environmental information collection module is greater than a set temperature, determining the second environmental information collection module to be the environmental information collection module to be supplied with air.

There are one, two, or more of the acquired current environmental data information. Preferably, in this embodiment, the first environmental information collection module may be a human body detection module, the second environmental information collection module may be a temperature sensor, and the third environmental information collection module may be a humidity sensor. In this way, when the acquired current environment temperature detected by one second environmental information collection module is greater than the set temperature, the second environmental information collection module may be determined to be the environmental information collection module to be supplied with air. The set temperature may be greater than or equal to the upper limit value of the set temperature range, and if the set temperature range is (18, 26), the set temperature may be 26, 27, or 28, etc.

For example: if the current environment temperature detected by one second environmental information collection module is greater than 28° C., the second environmental information collection module may be determined to be an environmental information collection module to be supplied with air. There may be one, two, or more environmental information collection modules to be supplied with air.

Step 503: determining the relative position with the environmental information collection module to be supplied with air.

There are many ways to determine the relative position with the environmental information collection module to be supplied with air, for example, infrared distance measurement or other distance measuring sensors. Preferably, the module position distance information is acquired through a short-range wireless short-range communication signal.

The air conditioner can perform wireless short-range communication with the environmental information collection module so that the arrival direction information about a wireless short-range communication signal carrying the current environment temperature can be determined; then, according to the arrival direction information, the relative position with the environmental information collection module to be supplied with air can be determined by the Angle-of-Arrival (AOV) location algorithm. The AOA location algorithm is a common self-localization algorithm for wireless sensor network nodes which has low communication overhead and high localization accuracy.

Step 504: adjusting the air deflector of the air conditioner and supplying air directionally to an area matching the relative position.

There may be one, two, or more environmental information collection modules to be supplied with air. When there is one environmental information collection module to be supplied with air, the air deflector of the air conditioner can be adjusted to directly supply air directionally to an area matching the relative position of the environmental information collection module to be supplied with air. When there are two or more environmental information collection modules to be supplied with air, the air deflector of the air conditioner can be adjusted to alternately supply air directionally to areas matching the relative position of each environmental information collection module to be supplied with air, or to randomly supply air directionally to areas matching the relative position of each environmental information collection module to be supplied with air.

Of course, in the present embodiment, there may be zero environmental information collection module to be supplied with air, that is to say, there is no current environment temperature detected by the second environmental information collection module being greater than a set temperature, and at this time, the swinging air adjustment of the air deflector of the air conditioner can be controlled.

It can be seen that in the present embodiment, the air conditioner can control the air supply direction of the air conditioner according to the environmental information collected by the environmental information collection module and the position information about the environmental information collection module, so as to further improve the intelligence of the air conditioner and also improve the user experience.

Also, in the present embodiment, not only the air conditioner in the operating state but also the air conditioner not in operation can be controlled, thereby further improving the intelligence of the air conditioner control and improving the user experience. It may include: starting the air conditioner to be in an operating state when the acquired number of human bodies detected by the first environmental information collection module is greater than a set value and the acquired environment temperature detected by at least one second environmental information collection module is not within a set temperature range.

Of course, before controlling the air conditioner, the air conditioner needs to perform matching with the environmental information collection module through networking, and it may include: sending identity identification information to the current environmental information collection module when it is determined that the signal strength of the wireless short-range communication signal of the current environmental information collection module satisfies a set condition; and receiving binding feedback information sent by the current environmental information collection module after the current environmental information collection module stores identity identification information and performing matching with the current environmental information collection module through networking. Performing matching through networking via the signal strength, the operation process is simple and improves the efficiency of matching through networking.

In the following descriptions, the operation procedures are gathered into specific embodiments to exemplify the method provided by the embodiments of the present disclosure.

In one embodiment of the present disclosure, in an air conditioning system, the air conditioner needs to perform matching with a corresponding environmental information collection module through networking.

Figure 6:
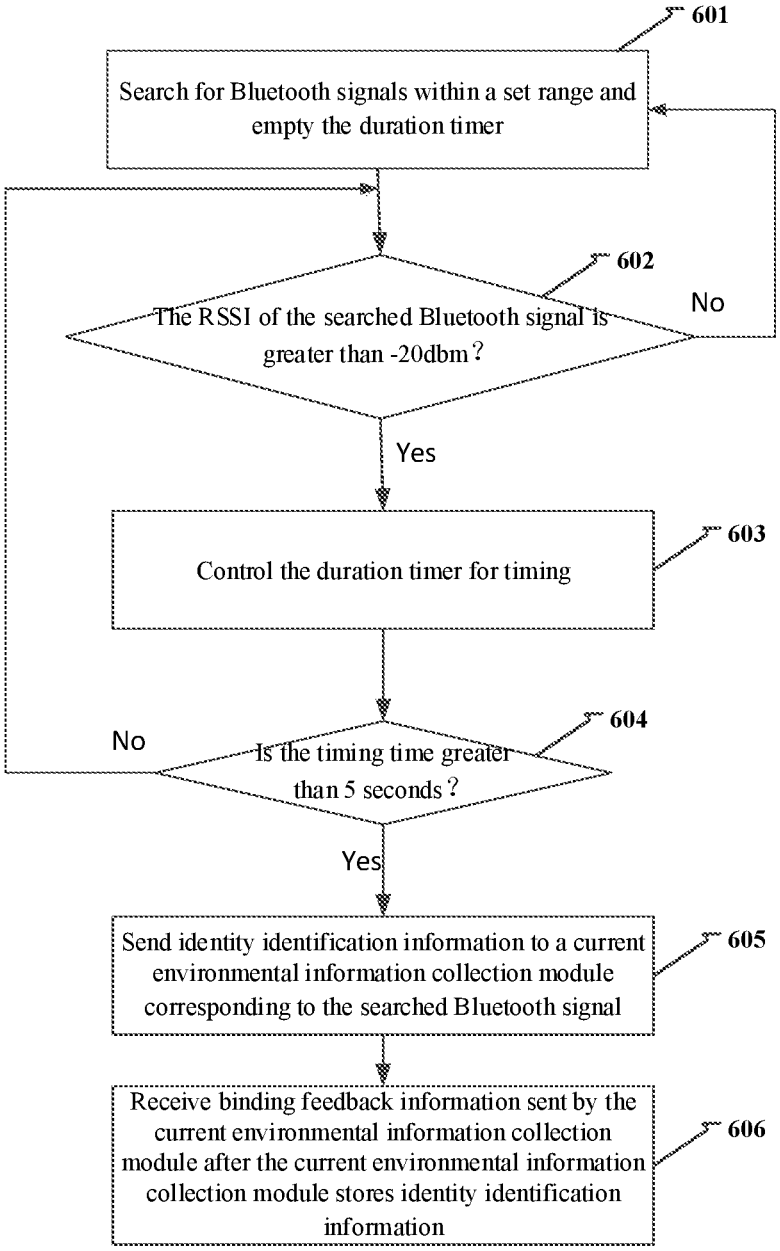
FIG. 6 is a flowchart of a method for matching elements through networking in an air conditioning system provided by an embodiment of the present disclosure.

FIG. 6 is a flowchart of a method for matching elements through networking in an air conditioning system according to one exemplary embodiment. The elements in the air conditioning system include: a centralized air-conditioning controller, an air conditioner, and an environmental information collection module. Preferably, the air conditioning system includes: a centralized air-conditioning controller, at least one air conditioner, and at least one environmental information collection module located in a working area of each air conditioner, wherein the environmental information collection module uses Bluetooth communication with the corresponding air conditioner, and uses 2.4 GHz radio frequency communication with the centralized air-conditioning controller. As shown in FIG. 6, the procedure of matching elements through networking in an air-conditioning system includes steps as follows:

Step 601: searching for Bluetooth signals within a set range and emptying the duration timer.

For example: searching for Bluetooth signals in the range of 2.5 meters in diameter.

Step 602: judging whether the RSSI of the searched Bluetooth signal is greater than −20 dbm. If so, step 603 is performed, otherwise, step 601 is returned to.

Step 603: controlling the duration timer for timing.

Step 604: judging whether the timing time is greater than 5 seconds. If so, step 605 is performed, otherwise, step 602 is returned to.

Step 605: sending identity identification information to a current environmental information collection module corresponding to the searched Bluetooth signal.

Step 606: receiving binding feedback information sent by the current environmental information collection module after the current environmental information collection module stores identity identification information.

In this way, according to the binding feedback information, matching with the current environmental information collection module through networking can be determined.

It can be seen that in the present embodiment, the air conditioner can actively perform matching with the environmental information collection module through networking, and this matching through networking mode is simple and easy to operate, thereby improving the efficiency of the air conditioning system architecture.

In one embodiment of the present disclosure, air conditioner control in an air conditioning system is based on data transmission among the environmental information collection module, the air conditioner, and the centralized air-conditioning controller.

Figure 7:
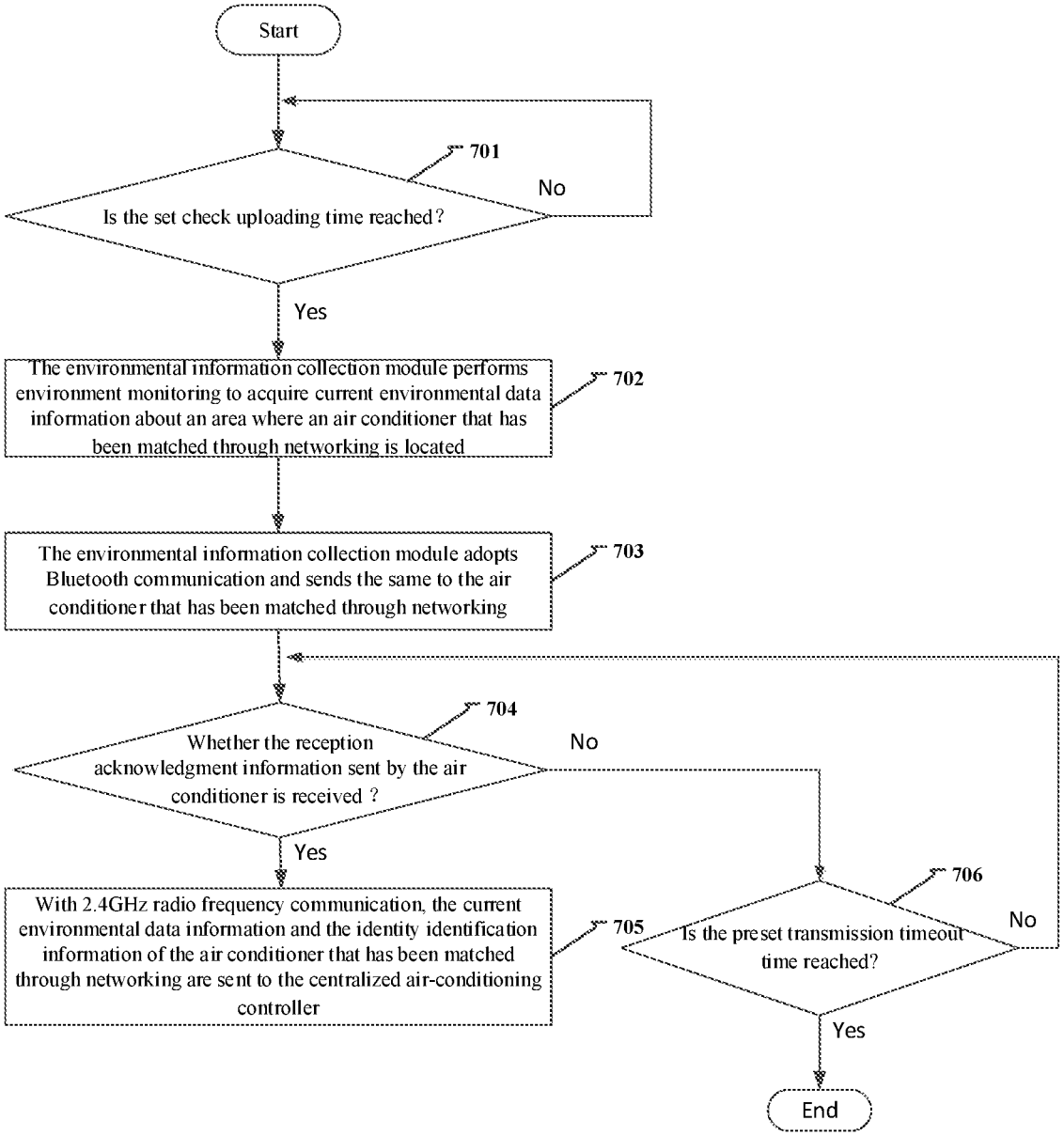
FIG. 7 is a flowchart of a data transmission method in an air conditioning system provided by an embodiment of the present disclosure.

FIG. 7 is a flowchart of a data transmission method in an air conditioning system according to an exemplary embodiment. The air conditioning system includes: a centralized air-conditioning controller, at least one air conditioner, and at least one environmental information collection module located in a working area of each air conditioner, wherein the environmental information collection module uses Bluetooth communication with the corresponding air conditioner, and uses 2.4 GHz radio frequency communication with the centralized air-conditioning controller. As shown in FIG. 7, the procedure of data transmission in an air conditioning system includes steps as follows:

Step 701: Is the set check uploading time reached? If so, step 702 is performed, otherwise, step 701 is returned to.

Step 702: the environmental information collection module performs environment monitoring to acquire current environmental data information about an area where an air conditioner that has been matched through networking is located.

Step 703: the environmental information collection module adopts Bluetooth communication and sends the same to the air conditioner that has been matched through networking.

Step 704: Judging whether reception acknowledgment information sent by the air conditioner is received? If so, step 705 is performed, otherwise, step 706 is performed.

Step 705: with 2.4 GHz radio frequency communication, the current environmental data information and the identity identification information of the air conditioner that has been matched through networking are sent to the centralized air-conditioning controller.

In this way, the centralized air-conditioning controller can synchronize the data information received by the corresponding air conditioner, thereby further enhancing the monitoring of the air conditioner.

Step 706: is the preset transmission timeout time reached? If so, the procedure ends. Otherwise, the procedure returns to step 704.

If the reception acknowledgment information sent by the air conditioner is not received within a certain time, this data transmission ends. The procedure of periodically monitoring uploading is continued.

It can be seen that in the present embodiment, the environmental information collection module can adopt a dual-mode communication mode so that environmental data can be communicated among the environmental information collection module, the air conditioner, and the centralized air-conditioning controller. In this way, power consumption is reduced, frequent changes in communication protocols are avoided, and communication reliability is improved.

In one embodiment of the present disclosure, elements of an air conditioning system have been matched through networking. Further, the environmental information collection module can adopt a dual-mode communication mode so that the air conditioner can be controlled. In this embodiment, the first environmental information collection module may be a human body detection module, the second environmental information collection module may be a temperature sensor, and the third environmental information collection module may be a humidity sensor.

Figure 8:
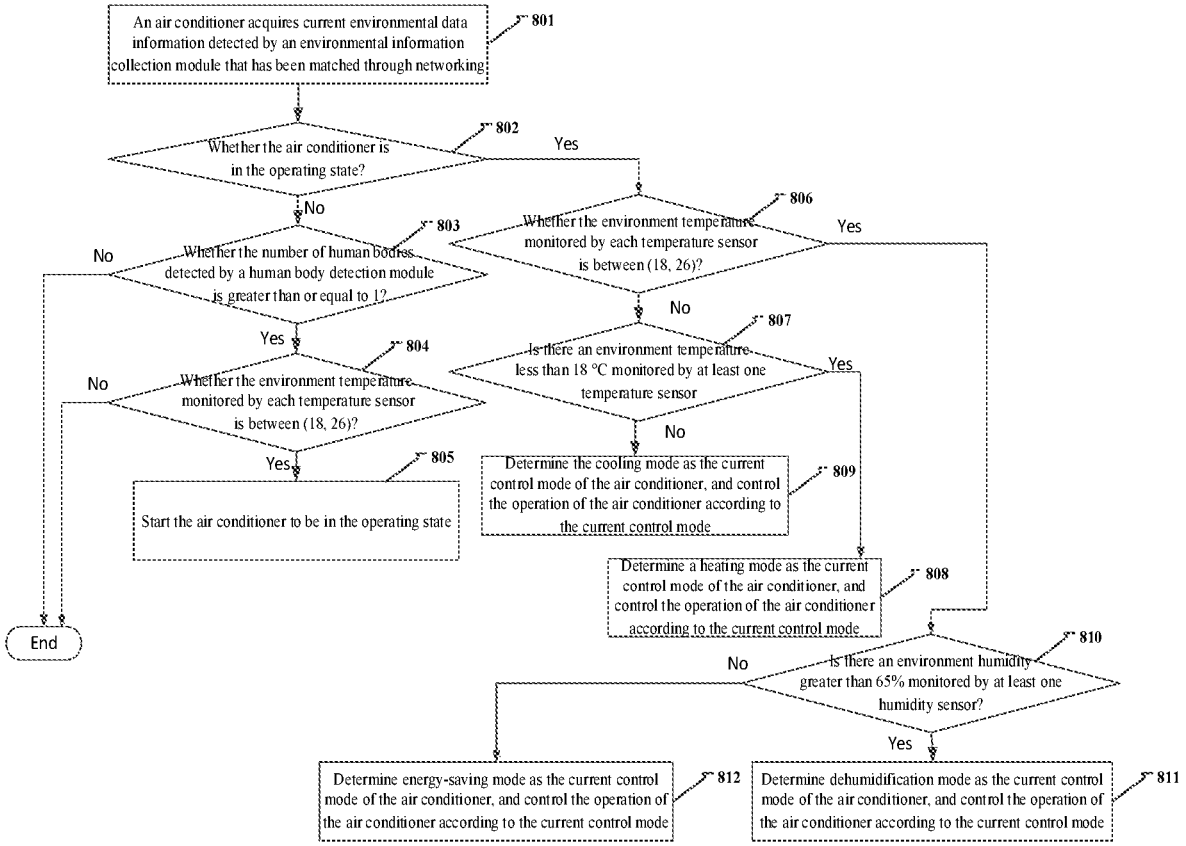
FIG. 8 is a flowchart of an air conditioner control method in an air conditioning system provided by an embodiment of the present disclosure.

FIG. 8 is a flowchart of an air conditioner control method in an air conditioning system according to an exemplary embodiment. The air conditioning system includes: a centralized air-conditioning controller, at least one air conditioner, and at least one environmental information collection module located in a working area of each air conditioner, wherein the environmental information collection module uses Bluetooth communication with the corresponding air conditioner, and uses 2.4 GHz radio frequency communication with the centralized air-conditioning controller. As shown in FIG. 8, the procedure of air conditioner control in the air conditioning system includes steps as follows:

Step 801: an air conditioner acquiring current environmental data information detected by an environmental information collection module that has been matched through networking.

Step 802: judging whether the air conditioner is in the operating state? If so, step 806 is performed, otherwise, step 803 is performed.

Step 803: judging whether the number of human bodies detected by a human body detection module in the acquired current environmental data information is greater than or equal to 1? If so, step 804 is performed, otherwise, the process ends.

Step 804: judging whether the environment temperature monitored by each temperature sensor in the acquired current environmental data information is between (18, 26)? If so, the process ends, otherwise, step 805 is performed.

Step 805: starting the air conditioner to be in the operating state.

Step 806: judging whether the environment temperature monitored by each temperature sensor in the acquired current environmental data information is between (18, 26)? If so, step 810 is performed, otherwise, step 807 is performed.

Step 807: judging whether, in the acquired current environmental data information, there is an environment temperature monitored by at least one temperature sensor less than 18° C.? If so, step 808 is performed, otherwise, step 809 is performed.

Step 808: determining a heating mode as the current control mode of the air conditioner, and controlling the operation of the air conditioner according to the current control mode.

Step 809: determining the cooling mode as the current control mode of the air conditioner, and controlling the operation of the air conditioner according to the current control mode.

Step 810: judging, in the acquired current environmental data information, whether there is an environment humidity monitored by at least one humidity sensor greater than 65%? If so, step 811 is performed, otherwise, step 812 is performed.

Step 811: determining dehumidification mode as the current control mode of the air conditioner, and controlling the operation of the air conditioner according to the current control mode.

Step 812: determining energy-saving mode as the current control mode of the air conditioner, and controlling the operation of the air conditioner according to the current control mode.

It can be seen that in the present embodiment, the air conditioner can adjust the current operation mode of at least one device in the air conditioner according to the environmental information collected by the environmental information collection module, so that the control quality in the working area can be detected relatively comprehensively by the environmental information collection module, and the corresponding air conditioner control can be performed. Therefore, the control optimization and energy-saving of the air conditioner are realized, and the comfort and experience of the user can also be further improved.

Figure 9:
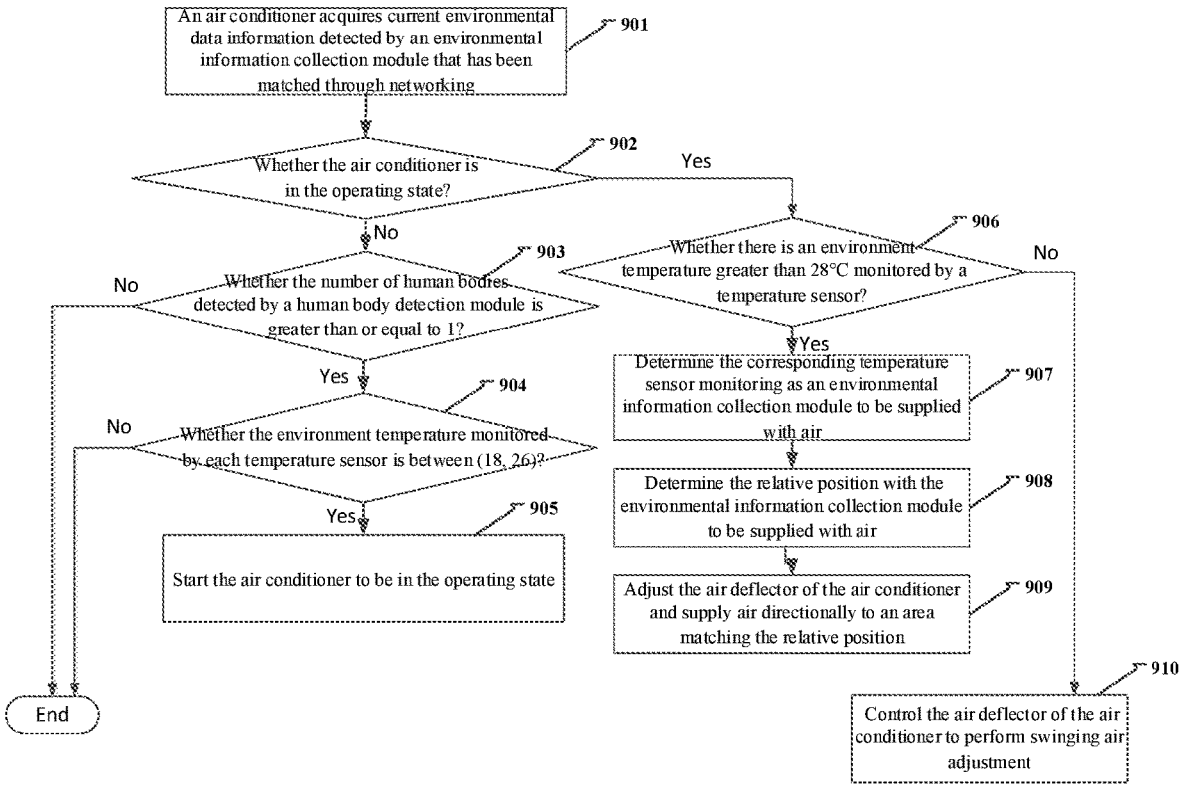
FIG. 9 is a flowchart of an air conditioner control method in an air conditioning system provided by an embodiment of the present disclosure.

FIG. 9 is a flowchart of an air conditioner control method in an air conditioning system according to an exemplary embodiment. The air conditioning system includes: a centralized air-conditioning controller, at least one air conditioner, and at least one environmental information collection module located in a working area of each air conditioner, wherein the environmental information collection module uses Bluetooth communication with the corresponding air conditioner, and uses 2.4 GHz radio frequency communication with the centralized air-conditioning controller. As shown in FIG. 9, the procedure of air conditioner control in the air conditioning system includes steps as follows:

Step 901: an air conditioner acquiring current environmental data information detected by an environmental information collection module that has been matched through networking.

Step 902: judging whether the air conditioner is in the operating state? If so, step 906 is performed, otherwise, step 903 is performed.

Step 903: judging whether the number of human bodies detected by a human body detection module in the acquired current environmental data information is greater than or equal to 1? If so, step 904 is performed, otherwise, the process ends.

Step 904: judging whether the environment temperature monitored by each temperature sensor in the acquired current environmental data information is between (18, 26)? If so, the process ends, otherwise, step 905 is performed.

Step 905: starting the air conditioner to be in the operating state.

Step 906: judging whether, in the acquired current environmental data information, there is an environment temperature monitored by a temperature sensor greater than 28° C.? If so, step 907 is performed, otherwise, step 910 is performed.

Step 907: determining the corresponding temperature sensor monitoring as an environmental information collection module to be supplied with air.

Step 908: determining the relative position with the environmental information collection module to be supplied with air.

Step 909: adjusting the air deflector of the air conditioner and supplying air directionally to an area matching the relative position.

Step 910: controlling the air deflector of the air conditioner to perform swinging air adjustment.

It can be seen that in the present embodiment, the air conditioner can control the air supply direction of the air conditioner according to the environmental information collected by the environmental information collection module and the position information about the environmental information collection module, so as to further improve the intelligence of the air conditioner and also improve the user experience.

The following are apparatus embodiments of the present disclosure that may be used to execute method embodiments of the present disclosure.

According to the above-mentioned procedure of elements matching through networking in an air conditioning system, an apparatus for matching elements through networking in an air conditioning system can be constructed.

Figure 10:
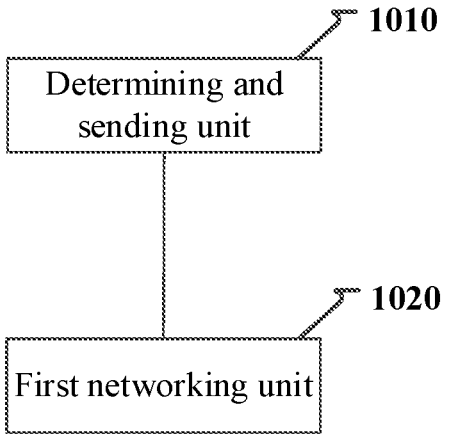
FIG. 10 is a block diagram of an apparatus for matching elements through networking in an air conditioning system provided by an embodiment of the present disclosure.

FIG. 10 is a block diagram of an apparatus for matching elements through networking in an air conditioning system according to an exemplary embodiment. The air conditioning system includes: a centralized air-conditioning controller, at least one air conditioner, and at least one environmental information collection module located in a working area of each air conditioner, wherein the environmental information collection module uses wireless short-range communication with the corresponding air conditioner, and uses radio frequency communication with the centralized air-conditioning controller. As shown in FIG. 10, the apparatus includes: determining and sending unit 1010 and a first networking unit 1020, wherein the determining and sending unit 1010 is configured to send identity identification information to the current environmental information collection module when it is determined that the signal strength of the wireless short-range communication signal of the current environmental information collection module satisfies a set condition.

The first networking unit 1020 is configured to receive the binding feedback information sent by the current environmental information collection module after the current environmental information collection module stores the identity identification information, and perform matching with the current environmental information collection module through networking.

In one embodiment of the present disclosure, the determining and sending unit 1010 includes:

a monitoring subunit configured to monitor a wireless short-range communication signal of the current environmental information collection module.

and a first determination subunit configured to determine that the signal strength of the wireless short-range communication signal satisfies the set condition when the time when the signal strength of the wireless short-range communication signal is greater than a set strength value is greater than a set time.

In one embodiment of the present disclosure, the determining and sending unit 1010 includes:

a receiving requesting subunit configured to receive a binding requesting signal sent by the current environmental information collection module via wireless short-range communication, and a second determination subunit configured to determine that the signal strength of the wireless short-range communication signal satisfies the set condition when the signal strength of the binding requesting signal is greater than the set strength value.

In one embodiment of the present disclosure, the apparatus further includes:

a second networking unit configured to perform matching with the centralized air-conditioning controller through networking by means of a communication bus.

According to the above-mentioned data transmission procedure in the air conditioning system, an apparatus for data transmission in the air conditioning system can be constructed.

Figure 11:
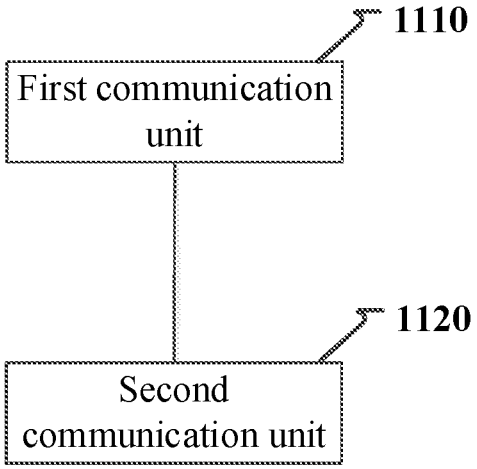
FIG. 11 is a block diagram of a data transmission apparatus in an air conditioning system provided by an embodiment of the present disclosure.

FIG. 11 is a block diagram of a data transmission apparatus in an air conditioning system according to an exemplary embodiment. The air conditioning system includes: a centralized air-conditioning controller, at least one air conditioner, and at least one environmental information collection module located in a working area of each air conditioner, wherein the environmental information collection module uses wireless short-range communication with the corresponding air conditioner, and uses radio frequency communication with the centralized air-conditioning controller. As shown in FIG. 11, the apparatus includes: a first communication unit 1110 and a second communication unit 1120.

The first communication unit 1110 is configured to, when a preset detection time is reached, detect current environmental data information about an area where the air conditioner that has been matched through networking is located, and by means of wireless short-range communication, send the current environmental data information to the air conditioner that has been matched through networking.

The second communication unit 1120 is configured to, when receiving reception acknowledgment information returned by the air conditioner that has been matched through networking, by means of radio frequency communication, send current environmental data information and identity identification information about the air conditioner that has been matched through networking to the centralized air-conditioning controller.

In one embodiment of the present disclosure, the apparatus further includes: a receiving and saving unit configured to receive identity identification information sent by the air conditioner, wherein the identity identification information is sent to the current environmental information collection module when the air conditioner determines that the signal strength of the wireless short-range communication signal of the current environmental information collection module satisfies a set condition; after the identity identification information is stored, sent the binding feedback information to the air conditioner.

In one embodiment of the present disclosure, the apparatus further includes: a sending requesting unit configured to send a binding requesting signal to the air conditioner through wireless short-range communication.

According to the above-mentioned procedure of air conditioner control in the air conditioning system, an apparatus for air conditioner control in an air conditioning system can be constructed.

Figure 12:
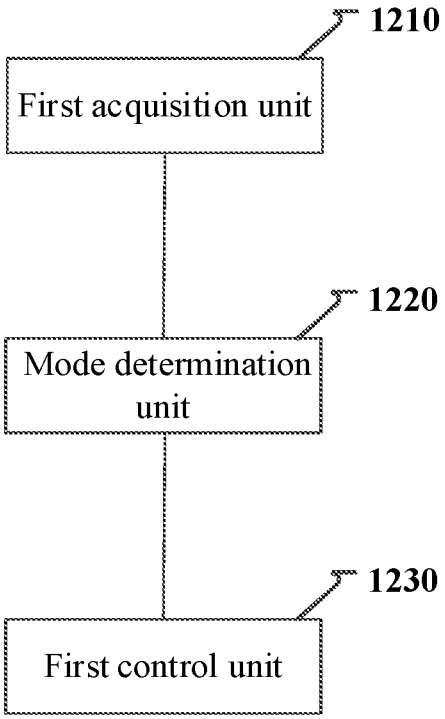
FIG. 12 is a block diagram of an air conditioner control apparatus in an air conditioning system provided by an embodiment of the present disclosure.

FIG. 12 is a block diagram of an air conditioner control apparatus in an air conditioning system according to an exemplary embodiment. The air conditioning system includes: a centralized air-conditioning controller, at least one air conditioner, and at least one environmental information collection module located in a working area of each air conditioner, wherein the environmental information collection module uses wireless short-range communication with the corresponding air conditioner, and uses radio frequency communication with the centralized air-conditioning controller. As shown in FIG. 12, the apparatus includes: a first acquisition unit 1210, a mode determination unit 1220, and a first control unit 1230.

The first acquisition unit 1210 is configured as follows: an air conditioner in an operating state acquires current environmental data information detected by the environmental information collection module that has been matched through networking;

the mode determination unit 1220 is configured to determine a current control mode that matches with the current environmental data information;

the first control unit 1230 is configured to control the operation of the air conditioner according to the current control mode.

In one embodiment of the present disclosure, a start control unit is further included which is configured to: start the air conditioner to be in an operating state when the acquired number of human bodies detected by the first environmental information collection module is greater than a set value and the acquired environment temperature detected by at least one second environmental information collection module is not within a set temperature range.

In one embodiment of the present disclosure, a networking matching unit is further included which is configured to:

send identity identification information to the current environmental information collection module when it is determined that the signal strength of the wireless short-range communication signal of the current environmental information collection module satisfies a set condition; and receive binding feedback information sent by the current environmental information collection module after the current environmental information collection module stores identity identification information and perform matching through networking with the current environmental information collection module.

In one embodiment of the present disclosure, the mode determination unit 1220 is configured to determine the heating mode as the current control mode when the acquired current environmental temperature detected by at least one second environmental information collection module is less than the lower limit value of a set temperature range; determine the cooling mode as the current control mode when the acquired current environmental temperature detected by at least one second environmental information collection module is greater than the upper limit value of the set temperature range; and determine the dehumidification mode as the current control mode when the acquired current environmental temperature detected by each second environmental information collection module is within the set temperature range, and the current environment humidity detected by at least one third environmental information collection module is greater than the set humidity.

According to the above-mentioned procedure of air conditioner control in the air conditioning system, an apparatus for air conditioner control in an air conditioning system can be constructed.

Figure 13:
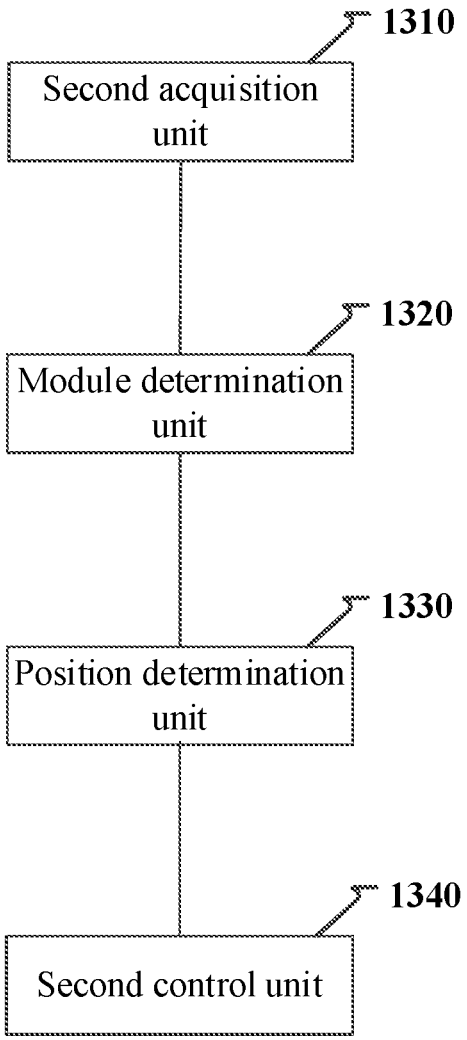
FIG. 13 is a block diagram of an air conditioner control apparatus in an air conditioning system provided by an embodiment of the present disclosure.

FIG. 13 is a block diagram of an air conditioner control apparatus in an air conditioning system according to an exemplary embodiment. The air conditioning system includes: a centralized air-conditioning controller, at least one air conditioner, and at least one environmental information collection module located in a working area of each air conditioner, wherein the environmental information collection module uses wireless short-range communication with the corresponding air conditioner, and uses radio frequency communication with the centralized air-conditioning controller. As shown in FIG. 13, the apparatus includes: a second acquisition unit 1310, a module determination unit 1320, a position determination unit 1330, and a first control unit 1340.

The second acquisition unit 1310 is configured as follows: an air conditioner in an operating state acquires current environmental data information detected by the environmental information collection module that has been matched through networking.

The module determination unit 1320 is configured to, when the acquired current environment temperature detected by the second environmental information collection module is greater than a set temperature, determine the second environmental information collection module to be an environmental information collection module to be supplied with air.

The position determination unit 1330 is configured to determine the relative position with the environmental information collection module to be supplied with air.

The second control unit 1340 is configured to adjust the air deflector of the air conditioner and supply air directionally to an area matching the relative position.

In one embodiment of the present disclosure, a start control unit is further included which is configured to: start the air conditioner to be in an operating state when the acquired number of human bodies detected by the first environmental information collection module is greater than a set value and the acquired environment temperature detected by at least one second environmental information collection module is not within a set temperature range.

In one embodiment of the present disclosure, a networking matching unit is further included which is configured to:

send identity identification information to the current environmental information collection module when it is determined that the signal strength of the wireless short-range communication signal of the current environmental information collection module satisfies a set condition; and receive binding feedback information sent by the current environmental information collection module after the current environmental information collection module stores identity identification information and perform matching through networking with the current environmental information collection module.

In one embodiment of the present disclosure, the position determination unit 1330 is configured to determine the arrival direction information of the wireless short-range communication signal carrying the current environment temperature; and, according to the arrival direction information, determine the relative position with the environmental information collection module to be supplied with air through the angle-of-arrival AOV location algorithm.

It can be seen that in the embodiments of the present disclosure, the air-conditioning system not only includes a centralized air-conditioning controller and at least one air conditioner, but also includes one, two, or more environmental information collection modules located in a working area of each air conditioner. In this way, the current operation mode of at least one device in the air conditioner can be adjusted according to the environmental information collected by the environmental information collection module, so that the control quality in the working area can be detected relatively comprehensively by the environmental information collection module, and the corresponding air conditioner control can be performed. Therefore, the control optimization and energy-saving of the air conditioner are realized, and the comfort and experience of the user can also be further improved. In addition, the environmental information collection module can adopt a dual-mode communication mode so that the environmental data can be communicated among the environmental information collection module, the air conditioner, and the centralized air-conditioning controller. In this way, power consumption is reduced, frequent changes in communication protocols are avoided, and communication reliability is improved.

In one embodiment of the present disclosure, there is provided an apparatus for matching elements through networking in an air conditioning system for air conditioners. The air conditioning system includes: a centralized air-conditioning controller, at least one air conditioner, and at least one environmental information collection module located in a working area of each air conditioner, wherein the environmental information collection module uses wireless short-range communication with the corresponding air conditioner, and uses radio frequency communication with the centralized air-conditioning controller. The apparatus includes:

a processor 14;

and a memory for storing a processor-executable instruction;

wherein the processor is configured to:

send identity identification information to the current environmental information collection module when it is determined that the signal strength of the wireless short-range communication signal of the current environmental information collection module satisfies a set condition;

and receive the binding feedback information sent by the current environmental information collection module after the current environmental information collection module stores the identity identification information, and perform matching with the current environmental information collection module through networking.

In one embodiment of the present disclosure, a computer-readable storage medium is provided having a computer instruction stored thereon which, when executed by a processor, implements the above-mentioned method for matching elements through networking in an air conditioning system.

An embodiment of the disclosure provides a computer program product including a computer program stored on a computer-readable storage medium. The computer program includes program instructions that, when executed by a computer, cause the computer to execute the above-mentioned method for matching elements through networking in an air conditioning system.

In one embodiment of the present disclosure, an apparatus for data transmission in an air conditioning system is provided for use in an environmental information collection module. The air conditioning system includes: a centralized air-conditioning controller, at least one air conditioner, and at least one environmental information collection module located in a working area of each air conditioner, wherein the environmental information collection module uses wireless short-range communication with the corresponding air conditioner, and uses radio frequency communication with the centralized air-conditioning controller. The apparatus includes:

a processor;

and a memory for storing a processor-executable instruction;

wherein the processor is configured to:

when a preset detection time is reached, detect current environmental data information about an area where the air conditioner that has been matched through networking is located, and by means of wireless short-range communication, send the current environmental data information to the air conditioner that has been matched through networking;

and when receiving reception acknowledgment information returned by the air conditioner that has been matched through networking, by means of radio frequency communication, send current environmental data information and identity identification information about the air conditioner that has been matched through networking to the centralized air-conditioning controller.

In one embodiment of the present disclosure, a computer-readable storage medium is provided having a computer instruction stored thereon which, when executed by a processor, implements the above-mentioned data transmission method in an air conditioning system.

An embodiment of the disclosure provides a computer program product including a computer program stored on a computer-readable storage medium. The computer program includes program instructions that, when executed by a computer, cause the computer to execute the above-mentioned data transmission method in an air conditioning system.

In one embodiment of the present disclosure, there is provided an apparatus for air conditioner control in an air conditioning system for use in air conditioners. The air conditioning system includes: a centralized air-conditioning controller, at least one air conditioner, and at least one environmental information collection module located in a working area of each air conditioner, wherein the environmental information collection module uses wireless short-range communication with the corresponding air conditioner, and uses radio frequency communication with the centralized air-conditioning controller. The apparatus includes:

a processor;

and a memory for storing a processor-executable instruction;

wherein the processor is configured to:

carry out the step as follows: an air conditioner in an operating state acquires current environmental data information detected by the environmental information collection module that has been matched through networking;

determine a current control mode that matches with the current environmental data information;

and control the operation of the air conditioner according to the current control mode.

In one embodiment of the present disclosure, a computer-readable storage medium is provided having a computer instruction stored thereon which, when executed by a processor, implements the above-mentioned air conditioner control method in an air conditioning system.

An embodiment of the disclosure provides a computer program product including a computer program stored on a computer-readable storage medium. The computer program includes program instructions that, when executed by a computer, cause the computer to execute the above-mentioned air conditioner control method in an air conditioning system.

In one embodiment of the present disclosure, there is provided an apparatus for air conditioner control in an air conditioning system for use in air conditioners. The air conditioning system includes: a centralized air-conditioning controller, at least one air conditioner, and at least one environmental information collection module located in a working area of each air conditioner, wherein the environmental information collection module uses wireless short-range communication with the corresponding air conditioner, and uses radio frequency communication with the centralized air-conditioning controller. The apparatus includes:

a processor;

and a memory for storing a processor-executable instruction;

wherein the processor is configured to:

carry out the step as follows: an air conditioner in an operating state acquires current environmental data information detected by the environmental information collection module that has been matched through networking;

when the acquired current environment temperature detected by the second environmental information collection module is greater than a set temperature, determine the second environmental information collection module to be an environmental information collection module to be supplied with air;

determine the relative position with the environmental information collection module to be supplied with air;

and adjust the air deflector of the air conditioner and supply air directionally to an area matching the relative position.

In one embodiment of the present disclosure, a computer-readable storage medium is provided having a computer instruction stored thereon which, when executed by a processor, implements the above-mentioned air conditioner control method in an air conditioning system.

An embodiment of the disclosure provides a computer program product including a computer program stored on a computer-readable storage medium. The computer program includes program instructions that, when executed by a computer, cause the computer to execute the above-mentioned air conditioner control method in an air conditioning system.

The computer-readable storage medium may be a transitory computer-readable storage medium or a non-transitory computer-readable storage medium.

Figure 14:
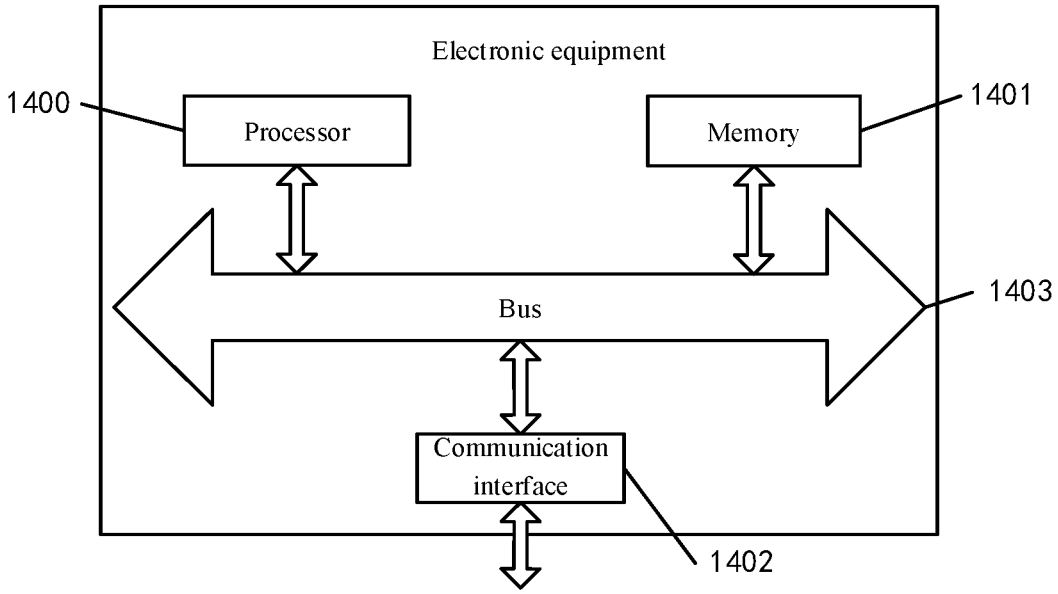
FIG. 14 is a schematic view showing a structure of electronic equipment provided by an embodiment of the present disclosure.

An embodiment of the present disclosure provides electronic equipment, the structure of which is shown in FIG. 14, the electronic equipment including:

at least one processor 1400, one processor 1400 being taken as an example in FIG. 14; and a memory 1401, which may also include a communication interface 1402 and a bus 1403. The processor 1400, the communication interface 1402, and the memory 1401 can communicate with each other through bus 1403. The communication interface 1402 may be used for information transmission. The processor 1400 may invoke logic instructions in memory 1401 to execute the method for data transmission in an air conditioning system of the above-mentioned embodiments.

Further, the above-mentioned logic instructions in the memory 1401 may be implemented in the form of software functional units and may be stored in one computer-readable storage medium when sold or used as a stand-alone product.

The memory 1401 serves as a computer-readable storage medium for storing a software program, a computer-executable program, and program instructions/modules corresponding to the method in the embodiments of the present disclosure. The processor 1400 executes functional applications and data processing by operating software programs, instructions, and modules stored in the memory 1401, i. e. implementing the method for data transmission in the air conditioning system in the above-mentioned method embodiment.

The memory 1401 may include a program storage area and a data storage area, wherein the program storage area may store an application program required by an operating system and at least one function; the data storage area may store data and the like created according to the use of the terminal equipment. In addition, memory 1401 may include high-speed random access memory and may also include non-volatile memory.

Technical solutions of embodiments of the present disclosure may be embodied in the form of a software product. The computer software product is stored in one storage medium and includes one or more instructions for causing one computer equipment (which may be a personal computer, a server, or network equipment, etc.) to execute all or part of the steps of the method of embodiments of the present disclosure. However, the above-mentioned storage medium can be a non-transitory storage medium, including: various media which can store program codes, such as U disk, mobile hard disk, read-only memory (ROM), random access memory (RAM), magnetic disk, or optical disk, etc., and can also be transitory storage media.

The foregoing description and drawings sufficiently illustrate embodiments of the present disclosure to enable those skilled in the art to practice them. Other embodiments may include structural, logical, electrical, procedural, and other changes. The embodiments merely represent possible changes. Individual components and functions are optional unless explicitly required otherwise, and the sequence of operations may change. Portions and features of some embodiments may be included in or substituted for those of other embodiments. The scope of embodiments of the disclosure includes the full scope of the claims, and all attainable equivalents of the claims. As used in this application, although the terms "first", "second", and the like may be used herein to describe various elements, these elements should not be limited by these terms. These terms are only used to distinguish one element from another. For example, a first element can be termed as a second element without changing the meaning of the description, and likewise, a second element can be termed as a first element, so long as all occurrences of the "first element" are identically renamed and all occurrences of the "second element" are identically renamed. Both the first element and the second element are elements, but may not be identical elements. Furthermore, the words used herein are used for describing embodiments only and are not intended to limit the claims. As used in the description of the embodiments and the claims, the singular forms "a", "an", and "the" are intended to include the plural forms as well, unless the context clearly indicates otherwise. Similarly, the term "and/or", as used herein, is meant to include any and all possible combinations of one or more of the associated list. In addition, the terms "comprise", variation thereof "comprises", and/or "comprising", etc. when used in this application, specify the presence of stated features, entireties, steps, operations, elements, and/or assemblies, but do not preclude the presence or addition of one or more other features, entireties, steps, operations, elements, assemblies, and/or groups thereof. An element defined by the phrase "including one" does not, without more constraints, preclude the existence of additional identical elements in the procedure, method, or equipment that includes the element. Each embodiment herein may focus on the differences from other embodiments, and the same or similar parts between the various embodiments can be referred to each other. For methods, products, etc. disclosed in the embodiments, if they correspond to the method part disclosed in the embodiments, for related details, reference is made to the description of the method part.

Those skilled in the art would recognize that the units and algorithm steps of the examples described in combination with the embodiments disclosed herein can be implemented by electronic hardware or a combination of computer software and electronic hardware. Whether such functionality is executed as hardware or software depends upon the particular application and design constraints of the technical solution. The technicians may use different methods for each specific application to realize the described functions, but such realization should not be considered as going beyond the scope of the embodiments of the present disclosure. Those skilled in the art can clearly understand that, for the convenience and conciseness of the description, the specific working procedure of the system, apparatus, and unit described above can refer to the corresponding procedure in the foregoing method embodiment, which will not be repeated here.

In the embodiments disclosed herein, the disclosed method and product (including but not limited to the apparatus, equipment, etc.), may be implemented in other ways. For example, the apparatus embodiments described above are merely illustrative. For example, the division of the units may only be a logical function division, and there may be other division modes in actual implementation. For example, multiple units or assemblies may be combined or integrated into another system, or some features can be ignored or not executed. Additionally, the couplings or direct couplings or communication connections shown or discussed with each other may be indirect couplings or communication connections through some interfaces, apparatuses, or units, and may be electrical, mechanical, or otherwise. The units described as separate components may or may not be physically separated, and the components displayed as units may or may not be physical units, that is, they may be located in one place, or they may be distributed on multiple network units. Some or all of the units may be selected according to actual needs to implement the embodiments. In addition, each functional unit in the embodiments of the present disclosure may be integrated into one processing unit, or each unit may exist alone physically, or two or more units may be integrated into one unit.

The flowcharts and block diagrams in the accompanying drawings show the possible implementation of system structure, functions, and operations of the system, method, and computer program product according to the embodiments of the present disclosure. In this regard, each block in the flowcharts or block diagrams may represent one module, a program segment, or a part of the code, which includes one or more executable instructions for implementing the specified logical function. In some alternative implementations, the functions noted in the blocks may also occur out of the order noted in the drawings. For example, two successive blocks may in fact be executed substantially in parallel, or they may sometimes be executed in the reverse order, depending on the functionality involved. In the description corresponding to the flowcharts and block diagrams in the drawings, operations or steps corresponding to different blocks may also occur in different orders from those disclosed in the description, and sometimes no particular order exists between different operations or steps. For example, two successive operations or steps may in fact be executed substantially in parallel, or they may sometimes be executed in the reverse order, depending on the functionality involved. Each block in the block diagrams and/or flowcharts, and the combination of the blocks in the block diagrams and/or flowcharts, can be implemented by a dedicated hardware-based system that executes the specified function or action, or can be implemented by a combination of dedicated hardware and computer instructions.

What is claimed is:

1. An air conditioning system, comprising: a centralized air-conditioning controller, at least one air conditioner, and at least one environmental information collection module located in a working area of each air conditioner, wherein the environmental information collection module includes at least a temperature sensor, a humidity sensor, a fine particle detection apparatus, a formaldehyde detection apparatus, a human body detection sensor, and a carbon monoxide detection sensor, and the environmental information collection module is used for detecting, when a preset detection time is reached, current environmental data information of an area where the air conditioner that has been matched through networking is located, and sending, by means of wireless short-range communication, the current environmental data information to the air conditioner that has been matched through networking, and sending, when reception acknowledgment information returned by the air conditioner that has been matched through networking is received and by means of radio frequency communication, the current environmental data information and saved identity identification information of the air conditioner that has been matched through networking to the centralized air-conditioning controller;

the air conditioner is used for controlling an operation of at least one device of the air conditioner according to the received current environmental data information; and the centralized air-conditioning controller is used for monitoring and controlling the operation of the air conditioner according to the received current environmental data information and the identity identification information; and wherein the air conditioner is also used for sending the identity identification information to the current environmental information collection module when it is determined that a signal strength of wireless short-range communication signal of the current environmental information collection module satisfies a set condition; and receiving binding feedback information sent by the current environmental information collection module after the current environmental information collection module stores the identity identification information and performing matching through networking with the current environmental information collection module.

2. The air conditioning system according to claim 1, wherein the air conditioner is also used for performing matching through networking with the centralized air-conditioning controller by means of a communication bus.

3. A data transmission apparatus in an air conditioning system according to claim 2, wherein the air conditioning system comprises: the centralized air-conditioning controller, the at least one air conditioner, and the at least one environmental information collection module located in the working area of each air conditioner, wherein the environmental information collection module adopts the wireless short-range communication with the corresponding air conditioner, and adopts the radio frequency communication with the centralized air-conditioning controller, the apparatus comprising:

a first communication unit configured to, when the preset detection time is reached, detect the current environmental data information about the area where the air conditioner that has been matched through networking is located, and by means of the wireless short-range communication, send the current environmental data information to the air conditioner that has been matched through the networking;

and a second communication unit configured to, when the receiving reception acknowledgment information returned by the air conditioner that has been matched through the networking, by means of the radio frequency communication, send the current environmental data information and the identity identification information about the air conditioner that has been matched through networking to the centralized air-conditioning controller; and wherein the apparatus further comprises:

a receiving and saving unit configured to receive the identity identification information sent by the air conditioner, wherein the identity identification information is sent to the current environmental information collection module when the air conditioner determines that a signal strength of wireless short-range communication signal of the current environmental information collection module satisfies a set condition; after the identity identification information is stored, sent the binding feedback information to the air conditioner.

4. A data transmission method in an air conditioning system, wherein the air conditioning system comprises: a centralized air-conditioning controller, at least one air conditioner, and at least one environmental information collection module located in a working area of each air conditioner, wherein the environmental information collection module adopts wireless short-range communication with a corresponding air conditioner, and adopts radio frequency communication with the centralized air-conditioning controller, the method comprising:

when a preset detection time is reached, detecting current environmental data information about an area where the air conditioner that has been matched through networking is located, and by means of wireless short-range communication, sending the current environmental data information to the air conditioner that has been matched through networking;

and when receiving reception acknowledgment information returned by the air conditioner that has been matched through networking, by means of radio frequency communication, sending the current environmental data information and identity identification information about the air conditioner that has been matched through networking to the centralized air-conditioning controller; and wherein the data transmission method further comprises:

receiving the identity identification information sent by the air conditioner, wherein the identity identification information is sent to the current environmental information collection module when the air conditioner determines that a signal strength of wireless short-range communication signal of the current environmental information collection module satisfies a set condition;

and sending binding feedback information to the air conditioner after the identity identification information is stored.

5. The data transmission method in the air conditioning system according to claim 4, wherein when the wireless short-range communication signal is a binding request signal, the method further comprises:

sending the binding request signal to the air conditioner through wireless short-range communication.

6. A non-transitory computer-readable storage medium having stored thereon a computer instruction, wherein the instruction, when executed by a processor, implements steps of the data transmission method described according to claim 4.

7. A data transmission apparatus in an air conditioning system for use in an environmental information collection module, wherein the air conditioning system comprises: a centralized air-conditioning controller, at least one air conditioner, and at least one environmental information collection module located in a working area of each air conditioner, wherein the environmental information collection module includes at least a temperature sensor, a humidity sensor, a fine particle detection apparatus, a formaldehyde detection apparatus, a human body detection sensor, and a carbon monoxide detection sensor, and the environmental information collection module adopts wireless short-range communication with a corresponding air conditioner, and adopts radio frequency communication with the centralized air-conditioning controller, the apparatus comprising:

a processor;

and a memory for storing a processor-executable instruction;

wherein the processor is configured to:

when a preset detection time is reached, detect current environmental data information about an area where the air conditioner that has been matched through networking is located, and by means of wireless short-range communication, send the current environmental data information to the air conditioner that has been matched through networking;

and when receiving reception acknowledgment information returned by the air conditioner that has been matched through networking, by means of radio frequency communication, send the current environmental data information and identity identification information about the air conditioner that has been matched through networking to the centralized air-conditioning controller; and wherein the air conditioner is also used for sending the identity identification information to the current environmental information collection module when it is determined that a signal strength of wireless short-range communication signal of the current environmental information collection module satisfies a set condition; and receiving binding feedback information sent by the current environmental information collection module after the current environmental information collection module stores the identity identification information and performing matching through networking with the current environmental information collection module.

* * * * *